US010288301B2

(12) United States Patent
Henderson et al.

(10) Patent No.: US 10,288,301 B2
(45) Date of Patent: May 14, 2019

(54) THERMOSTAT HOOD FOR A HEATING SYSTEM OF AN AIR CONDITIONER UNIT

(71) Applicant: General Electric Company, Schenectady, NY (US)

(72) Inventors: Richard Dustin Henderson, La Grange, KY (US); David William Billman, Louisville, KY (US); Torrey Jacob Tarschis, Cincinnati, OH (US)

(73) Assignee: Haier US Appliance Solutions, Inc., Wilmington, DE (US)

( * ) Notice: Subject to any disclaimer, the term of this patent is extended or adjusted under 35 U.S.C. 154(b) by 419 days.

(21) Appl. No.: 14/681,185

(22) Filed: Apr. 8, 2015

(65) Prior Publication Data

US 2016/0298862 A1 Oct. 13, 2016

(51) Int. Cl.
*F24D 19/10* (2006.01)

(52) U.S. Cl.
CPC ..... *F24D 19/1087* (2013.01)

(58) Field of Classification Search
CPC .. F24D 19/1097; F24D 19/1087; F25B 49/02; F24F 1/027; F24F 13/20; F24F 2013/207; F24F 1/02; F24F 1/04
See application file for complete search history.

(56) References Cited

U.S. PATENT DOCUMENTS 2,220,061 A * 11/1940 Brown ..... F24F 3/14 236/44 A
2,476,498 A * 7/1949 Lofgren ..... G01K 5/62 337/394
2,578,819 A * 12/1951 Mast ..... F24H 3/0411 219/513
2,891,389 A * 6/1959 Tull ..... F24F 1/02 62/262
2,971,076 A * 2/1961 Ferguson ..... F24H 3/0411 219/481
3,185,393 A * 5/1965 Norris ..... F24F 11/0009 236/38
3,293,875 A * 12/1966 Kelly ..... F24F 11/053 236/38
3,834,618 A * 9/1974 Buckwalter ..... G04C 23/16 219/511

(Continued)

FOREIGN PATENT DOCUMENTS

JP 2005043024 A 2/2005

*Primary Examiner* — Kun Kai Ma
(74) *Attorney, Agent, or Firm* — Dority & Manning, P.A.

(57) ABSTRACT

A heating system for an air conditioner unit may generally include a heating coil and a thermostat supported above the heating coil by a support mount. The system may also include a thermostat hood configured to at least partially surround the thermostat. The thermostat hood may include a front wall spaced apart from the support mount and a top wall extending between the front wall and the support mount. The thermostat hood may further include first and second sidewalls extending between the front wall and the support mount. The front wall, the top wall, the sidewalls and the support mount may collectively define a hood chamber for receiving at least a portion of the thermostat. Moreover, at least a portion of the bottom side of the thermostat hood may define an air intake opening for receiving heated air rising upward from the heating coil.

20 Claims, 5 Drawing Sheets

(56) References Cited

U.S. PATENT DOCUMENTS 4,110,600 A * 8/1978 Spotts ..... F24H 3/0417 126/110 AA
4,271,899 A * 6/1981 Noland ..... F02D 21/02 165/233
4,315,137 A * 2/1982 Dahms ..... G05D 23/30 219/391
4,524,588 A * 6/1985 Bond ..... F24F 1/027 62/262
4,587,403 A * 5/1986 Shapess ..... G05D 23/1905 219/209
4,761,964 A * 8/1988 Pacheco ..... F24F 1/022 165/240
4,804,821 A * 2/1989 Glucksman ..... A61L 9/03 261/DIG. 89
4,835,981 A * 6/1989 Rinholen ..... F24F 1/022 236/DIG. 19
5,087,794 A * 2/1992 Nelson ..... H05K 5/0208 174/547
5,372,189 A * 12/1994 Tsunekawa ..... F24F 1/027 165/59
5,381,509 A * 1/1995 Mills ..... F24C 1/14 392/376
5,461,880 A * 10/1995 Bolton ..... F24F 13/20 62/262
5,895,597 A * 4/1999 Sherrill ..... H05B 3/16 219/532
6,009,717 A * 1/2000 Hernandez ..... F24F 1/027 62/262
6,020,577 A * 2/2000 Barker ..... H01C 1/012 219/536
6,094,839 A * 8/2000 Nikolov ..... A47L 23/205 34/225
6,318,105 B1 * 11/2001 Bushnell ..... F24F 1/027 62/262
6,940,051 B2 * 9/2005 Tateishi ..... F24H 9/2071 219/486
8,802,981 B2 * 8/2014 Wallaert ..... F24F 11/00 174/489
2003/0015513 A1 * 1/2003 Ellis ..... A47K 10/06 219/400
2003/0029184 A1 * 2/2003 Ohama ..... F24F 13/06 62/262
2003/0127458 A1 * 7/2003 Dushane ..... H02G 3/081 220/241
2005/0252033 A1 * 11/2005 Loesch ..... D06F 58/26 34/604
2008/0156891 A1 * 7/2008 Zhou ..... F24F 1/027 236/44 C
2009/0062965 A1 * 3/2009 Alhilo ..... G05B 5/01 700/278
2009/0069946 A1 * 3/2009 Rhodes ..... G05D 23/1902 700/278
2009/0090115 A1 * 4/2009 Boydstun ..... F24F 11/30 62/126
2010/0020849 A1 * 1/2010 Wille ..... G01K 1/20 374/208
2010/0212861 A1 * 8/2010 Setsu ..... F24F 13/30 165/64
2013/0239601 A1 * 9/2013 Albertson ..... F24F 3/044 62/159

* cited by examiner

THERMOSTAT HOOD FOR A HEATING SYSTEM OF AN AIR CONDITIONER UNIT

FIELD OF THE INVENTION

The present subject matter relates generally to heating systems for air conditioner units and, more particularly, to a thermostat hood for covering a thermostat(s) of a heating system of an air conditioner unit.

BACKGROUND OF THE INVENTION

Air conditioner units are typically utilized to adjust the temperature within structures, such as dwellings and/or office buildings. In particular, one-unit type room air conditioner units are often utilized to adjust the temperature in, for example, a single room or group of rooms of a structure. Such an air conditioner unit typically includes an indoor portion and an outdoor portion. The indoor portion is generally located indoors, and the outdoor portion is generally located outdoors. Accordingly, the air conditioner typically extends through a wall, window, etc. of the structure.

The outdoor portion of a conventional air conditioner unit typically includes a compressor, an outdoor heat exchanger connected to the compressor and an outdoor fan for cooling the outdoor heat exchanger. Similarly, the indoor portion of a conventional air conditioner unit typically includes an air inlet and an air outlet positioned along the front portion of the unit facing the interior of the room. In addition, the indoor portion typically includes a blower fan, a heating system and an indoor heat exchanger connected to the compressor.

During cooling operation, the compressor is driven to implement a refrigeration cycle, with the indoor heat exchanger serving as a cold-side evaporator of the refrigeration cycle and the outdoor heat exchanger serving as a hot-side condenser. The outdoor heat exchanger is cooled by the outdoor fan to dissipate heat. As the blower fan is driven, the air inside the room flows through the air inlet, has its temperature lowered via heat transfer with the indoor heat exchanger and is then blown into the room through the air outlet in order to cool the room.

During heating operation, the heating system is operated to raise the temperature of air flowing through the unit. For example, the heating system typically includes a plurality of heating coils configured to heat the air passing through the unit. Thus, air directed through the unit is heated by the heating coils and is subsequently discharged therefrom via the air outlet in order to heat the room.

To prevent an air conditioner unit from overheating during its heating operation, a thermostat is typically provided in operative association with the heating system that is configured to regulate the internal temperature of the unit by cutting the power to the heating coils off when the internal temperature exceeds a predetermined cut-off temperature. Unfortunately, due to their configuration and/or arrangement within air conditioner units, conventional thermostats are often slow to detect temperature increases within the unit that may lead to overheating. This is particularly true when all or a portion of the airflow through the unit is blocked or restricted.

Accordingly, an improved thermostat configuration and/or arrangement within an air conditioner unit that provides the thermostat with increased reaction time and/or responsiveness would be welcomed in the technology.

BRIEF DESCRIPTION OF THE INVENTION

Aspects and advantages of the invention will be set forth in part in the following description, or may be obvious from the description, or may be learned through practice of the invention.

In one aspect, the present subject matter is directed to a heating system for an air conditioner unit. The system may generally include a heating coil and a thermostat positioned above the heating coil. The thermostat may be configured to regulate a temperature within the air conditioner unit and may be supported above the heating coil by a support mount. The system may also include a thermostat hood configured to at least partially surround the thermostat. The thermostat hood may extend vertically between a top side and a bottom side and laterally between a first side and a second side. The thermostat hood may include a front wall spaced apart from the support mount and a top wall extending between the front wall and the support mount so as to define the top side of the thermostat hood. The thermostat hood may further include first and second sidewalls extending between the front wall and the support mount so as to define the first and second sides of the thermostat hood, respectively. The front wall, the top wall, the first and second sidewalls and the support mount may collectively define a hood chamber for receiving at least a portion of the thermostat. Moreover, at least a portion of the bottom side of the thermostat hood may define an air intake opening for receiving heated air rising upward from the heating coil.

In another aspect, the present subject matter is directed to a heating system for an air conditioner unit. The system may generally include a heating coil and first and second thermostats positioned above the heating coil. The first and second thermostats may be supported above the heating coil by a support mount. The system may also include a thermostat hood configured to at least partially surround the first and second thermostats. The thermostat hood may extend vertically between a top side and a bottom side and laterally between a first side and a second side. The thermostat hood may include a front wall spaced apart from the support mount and a top wall extending between the front wall and the support mount so as to define the top side of the thermostat hood. The thermostat hood may further include first and second sidewalls extending between the front wall and the support mount so as to define the first and second sides of the thermostat hood, respectively. The front wall, the top wall, the first and second sidewalls and the support mount may collectively define a hood chamber for receiving at least a portion of each of the first and second thermostats. Moreover, at least a portion of the bottom side of the thermostat hood may define an air intake opening below at least one of the first thermostat or the second thermostat for receiving heated air rising upward from the heating coil and the top wall may define at least one exhaust opening for expelling the heated air flowing into the hood chamber via the air intake opening.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures, in which.

DETAILED DESCRIPTION OF THE INVENTION

Figure 1:
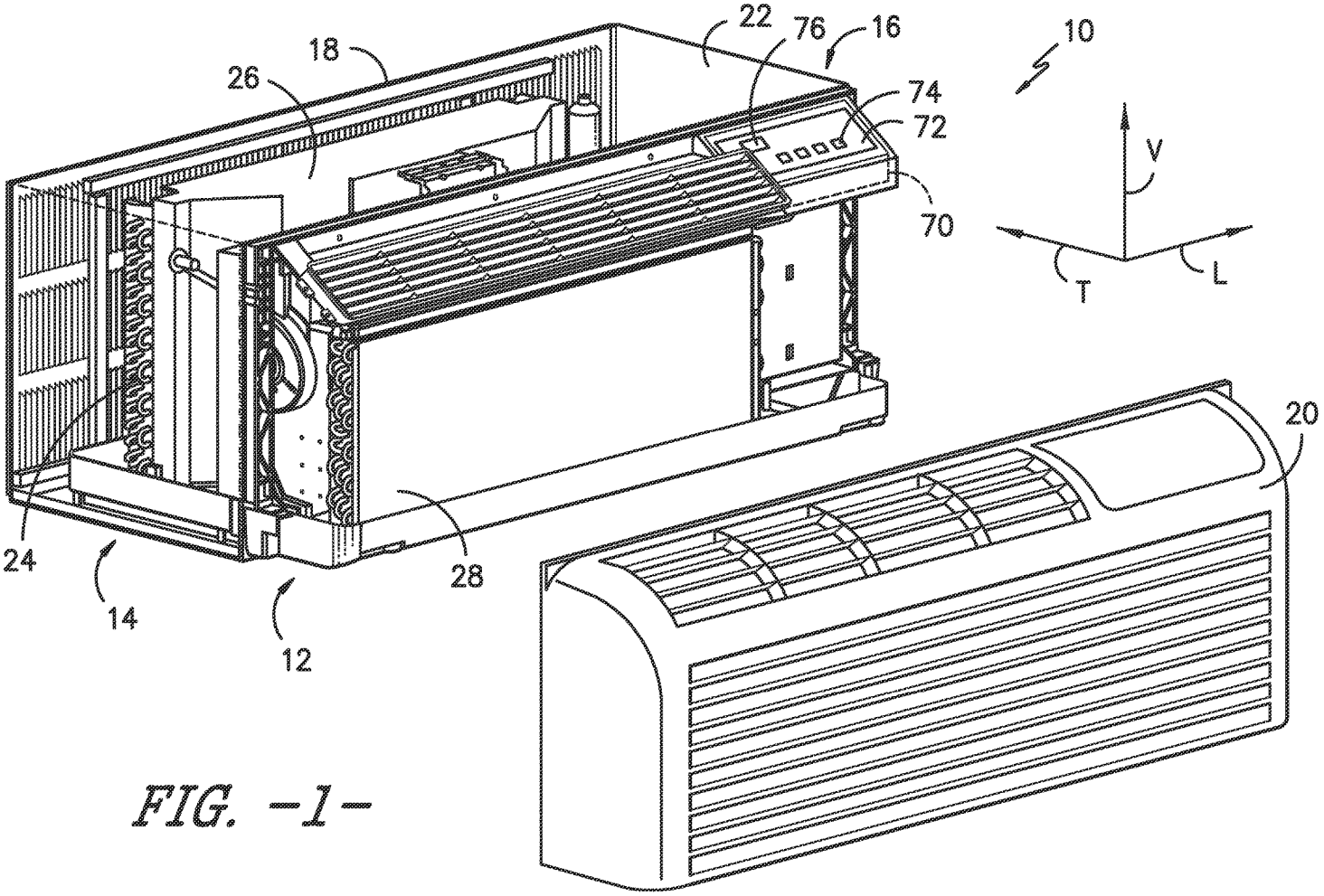
FIG. 1 illustrates a perspective view of one embodiment of an air conditioner unit in accordance with aspects of the present subject matter, particularly illustrating a room front of the air conditioner unit exploded away from the remainder of the unit for illustrative purposes.

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents.

In general, the present subject matter is directed to a heating system for an air conditioner unit that includes one or more thermostats and a thermostat hood configured to at least partially encase or surround the thermostat(s). Specifically, as will be described below, the thermostat(s) may be positioned directly above one or more of the heating coils of the heating system and may be configured to regulate the internal temperature of the air conditioner unit by controlling the supply of power to the coil(s). Additionally, the thermostat hood may be configured to be mounted around the thermostat(s) to allow heated air rising from the heating coil(s) to be drawn across the thermostat(s). Specifically, in several embodiments, the thermostat hood may include one or more air intake openings defined along its bottom side and one or more air exhaust openings defined along its top side. As such, when the thermostat hood is installed around the thermostat(s), the heated air rising from the heating coil(s) may be drawn into the hood via the air intake opening(s), flow past the thermostat(s) and may then be expelled from the hood via the air exhaust opening(s). Such a continuous flow of air through the thermostat hood may provide for enhanced convective heat transfer between the heated air and the thermostat(s), thereby improving the reaction time and performance of the thermostat(s). Such improved reaction time may be particularly advantageous when the airflow through the air conditioner unit is limited or otherwise restricted, such as when an airflow component of the unit (e.g., the air inlet and/or the air outlet) is partially or fully blocked.

Figure 2:
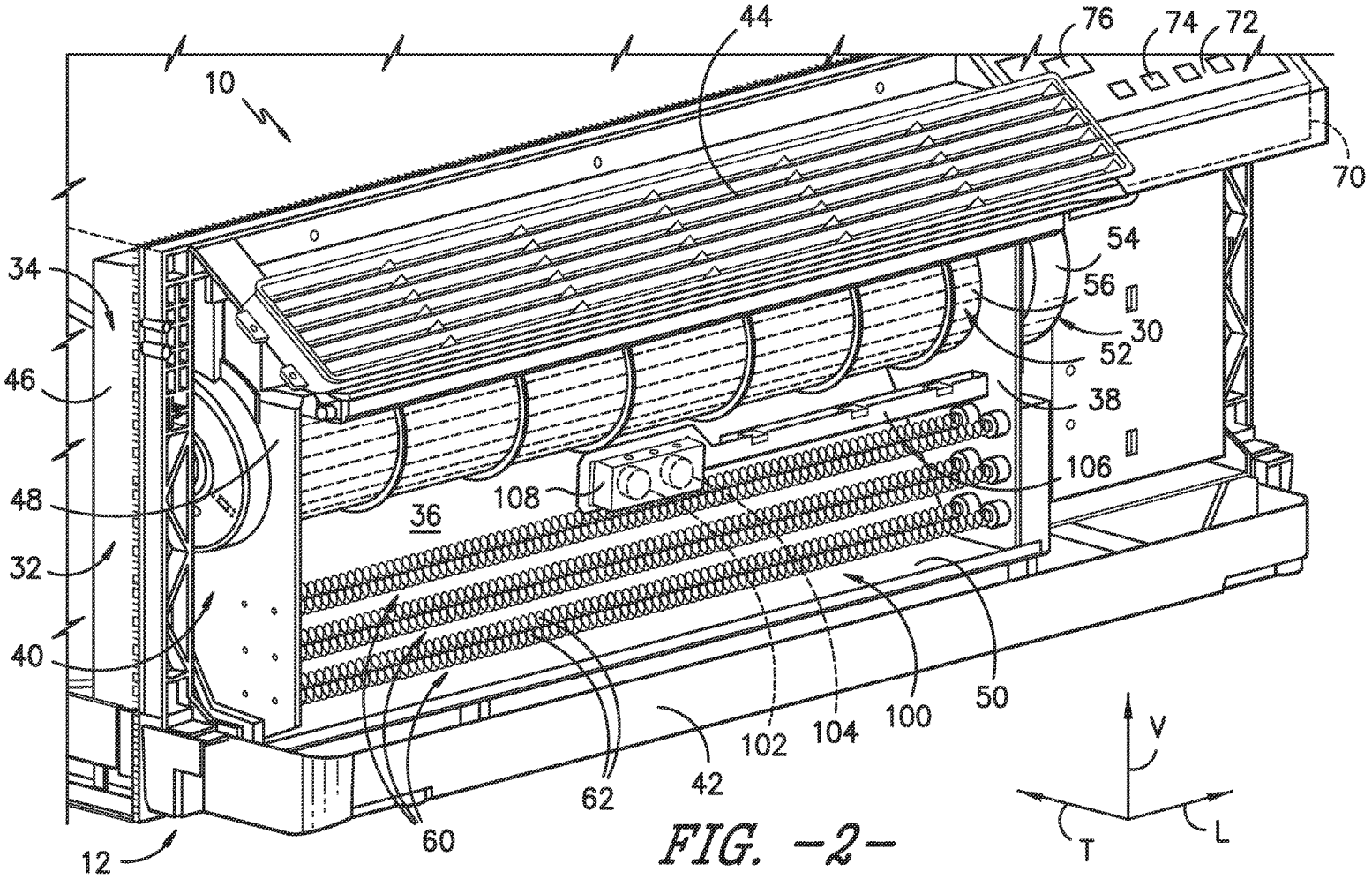
FIG. 2 illustrates a perspective view of various components of an indoor portion of the air conditioner unit shown in FIG. 1, particularly illustrating one embodiment of components of a heating system of the air conditioner unit in accordance with aspects of the present subject matter.

Referring now to FIGS. 1 and 2, one embodiment an air conditioner unit 10 is illustrated in accordance with aspects of the present subject matter. Specifically, FIG. 1 illustrates a perspective view of various components of the air conditioner unit 10, particularly illustrating a room front of the air conditioner unit 10 exploded away from the remainder of the unit 10 for illustrative purposes. Additionally, FIG. 2 illustrates a perspective view of various components of an indoor portion of the air conditioner unit 10 shown in FIG. 1, particularly illustrating one embodiment of a heating system 100 of the unit 10 in accordance with aspects of the present subject matter.

As shown in the illustrated embodiment, the air conditioner unit 10 is configured as a one-unit type air conditioner, which is also often referred to as a room air conditioner. Thus, the unit 10 may generally include an indoor portion 12 and an outdoor portion 14. Additionally, as shown in FIGS. 1 and 2, the air conditioner unit 10 may generally define a vertical direction V, a lateral direction L, and a transverse direction T. Each direction V, L, T is perpendicular to the other defined directions such that an orthogonal coordinate system is generally defined.

As particularly shown in FIG. 1, a housing 16 of the air conditioner unit 10 may be configured to contain or house various components of the unit 10. For example, the housing 10 may include a rear grill 18 and a room front 20 configured to be spaced apart from one another along the transverse direction T by a wall sleeve 22. As is generally understood, the rear grill 18 may form part of the outdoor portion 14 of the unit 10, with the room front 20 forming part of the indoor portion 12 of the unit 10. In general, various components of the outdoor portion 14, such as an outdoor heat exchanger 24, outdoor fan (not shown), and compressor (not shown) may be housed within the housing 16. Additionally, a casing 26 may enclose the outdoor fan, as shown in FIG. 1.

As particularly shown in FIGS. 1 and 2, the indoor portion 12 of the air conditioner unit 10 may include, for example, an indoor heat exchanger 28, a blower fan 30, and a heating system 100. In several embodiments, these components may be housed behind the room front 20 within a heater housing 32 configured to extend in the traverse direction T from the room front 20. As particularly shown in FIG. 2, the heater housing 32 may include peripheral surfaces 34 that define a housing interior 36. For example, the peripheral surfaces 34 may include a first sidewall 38 and a second sidewall 40 spaced apart from the first sidewall 38 along the lateral direction L. Additionally, the peripheral surfaces 34 may also include a base pan 42 and an outlet air diverter 44, each of which may extend between the first and second sidewalls 38, 40 along the lateral direction L.

It should be appreciated that the housing 32 may be formed from one or more components. For example, in several embodiments, the housing 32 may be formed from a bulkhead 46 and a shroud 48. In such embodiments, the shroud 48 may be coupled to the bulkhead 46 such that the bulkhead 46 and the shroud 48 collectively include or define the peripheral surfaces 34. For example, the base pan 42 and the outlet air diverter 44 may correspond to components of the bulkhead 46, whereas all or a portion of the sidewalls 38, 40 may correspond to components of the shroud 48. In addition, the shroud 48 may include an interior shroud base 64, which may, for example, be disposed within the housing interior 36 generally adjacent to the base pan 42.

Additionally, it should be appreciated that, in several embodiments, the blower fan 30 may correspond to a tangential fan. However, in other embodiments, the blower fan 30 may correspond to any other suitable type of fan. As shown in FIG. 2, the blower fan 30 may include a blade assembly 52 and a motor 54. The blade assembly 52 may generally be positioned within the interior 36 of the heating housing 32 and may include may include one or more blades (not shown) disposed within a fan housing 56. As shown in FIG. 2, the blade assembly 54 may be configured to extend in the lateral direction L between the first and second sidewalls 38, 40. Additionally, the motor 54 may be configured to be rotatably coupled to the blade assembly 52. As such, operation of the motor 54 may rotate the blades of the blade assembly 52, thus generally operating the blower fan 30. As shown in the illustrated embodiment, the motor 54 is disposed on the exterior of the heater housing 32 along the first sidewall 38. As such, the shaft of the motor 54 may be configured to extend through the sidewall 38 in order to couple the motor 54 to the blade assembly 54.

In several embodiments, the heating system 100 may include one or more heater banks 60. Each heater bank 60 may be individually powered, separately from other heater banks 60, so as to provide heat. As shown in the illustrated embodiment, the heating system 100 includes three heater banks 60. However, in other embodiments, the heating system 100 may include any other suitable number of heater banks 60. Additionally, in several embodiments, each heater bank 60 may have a different rated power level. For example, in one embodiment, the heating system 100 may include a low power heater bank, a medium power heater bank and a high power heater bank, such as by including a 1000 Watt heater bank, a 1400 Watt heater bank, and a 2400 Watt heater bank.

Moreover, each heater bank 60 may include at least one coil pass or heating coil 62. For example, as shown in FIG. 2, each heater bank 60 includes two heating coils 62. However, in other embodiments, each heater bank 60 may include a single heating coil 62 or three or more heating coils 62. Additionally, in several embodiments, the heater banks 60 may be configured to be stacked vertically, with the coils 62 of each heater bank 60 being arranged side-by-side. For example, as shown in the illustrated embodiment, the heater banks 60 are stacked vertically such that the heating system 100 includes a two-by-three array of heating coils 62.

It should be appreciated that the operation of the various components of the air conditioner unit 10 may be controlled via a controller 70. In general, the controller 70 may correspond to any suitable computer and/or processor unit. As such, the controller 70 may include one or more processors and associated memory. The memory may be configured to stored computer-readable instructions that, when implemented by the processor(s), configure the controller 70 to perform one or more computer-implemented functions, such as controlling the operation of one or more components of the air conditioner unit 10.

Additionally, the air conditioner unit 10 may also include a control panel 72 containing one or more user input devices 74 (e.g., buttons) communicatively coupled to the controller 70. As such, a user of the unit 10 may interact with the user input devices 74 in order control the operation of the unit 10, with user command signals being transmitted from the user input devices 74 to the controller 70 to facilitate operational control of the unit 10 based on the user commands. Moreover, a display 76 may also be provided on the control panel 72. The display 76 may, for example, be a touchscreen or other text-readable display screen or, alternatively, may simply be a light that can be activated/deactivated as required to provide an indication of, for example, an event or setting for the unit 10.

Referring particularly to FIG. 2, the heating system 100 may also include one or more thermostats 102, 104 positioned above the heating coils 62 (e.g., above the top row of heating coils 62). Specifically, as shown in the illustrated embodiment, the heating system 100 includes first and second thermostats 102, 104 coupled to a support mount 106 extending outwardly from the sidewall 38 of the heater housing 32 such that the thermostats 102, 104 are positioned directly above the heating coils 62. However, in other embodiments, the heating system 100 may only include a single thermostat or three or more thermostats positioned directly above the heating coils 62. However, in other embodiments, the heating system 100 may only include a single thermostat or three or more thermostats positioned directly above the heating coils 62.

In general, the thermostats 102, 104 may be configured to regulate the internal temperature within the air conditioner unit 10. Specifically, in several embodiments, when the air temperature directly above the heating coils 62 exceeds a given threshold temperature (hereinafter referred to as the cut-off temperature), one or both of the thermostats 102, 104 may be configured to cut the supply of power to the heating coils 62. For example, as will be described below, each thermostat 102, 104 may include a temperature sensitive element, such as bimetallic spring element or a thermal fuse, that is configured to adjust its position (e.g., by springing or bowing inwardly or outwardly or by snapping) when the air temperature around the thermostat 102, 104 reaches the associated cut-off temperature. In such an embodiment, the temperature sensitive element may trip the system 100 when the temperature reaches the cut-off temperature, thereby cutting off the power supply to the heating coils 62 and allowing the internal temperature within the air conditioner unit 10 to be reduced.

Moreover, in several embodiments, the heating system 100 may also include a thermostat hood 108 configured to at least partially surround or encase the thermostats 102, 104. In general, the thermostat hood 108 may be configured to provide a means for directing the heated air rising from the heating coils 62 across the thermostat(s) 102, 104. For instance, as will be described below, a bottom side of the thermostat hood 108 may be at least partially open to allow the heated air to be drawn across the face of one or both of the thermostats 102, 104, thereby improving the convective heat transfer between the air and the thermostat(s) 102, 104. As a result, the reaction time of the thermostat(s) 102, 104 may be increased significantly, particularly when airflow through the air condition unit 10 is restricted or otherwise limited.

Figure 3:
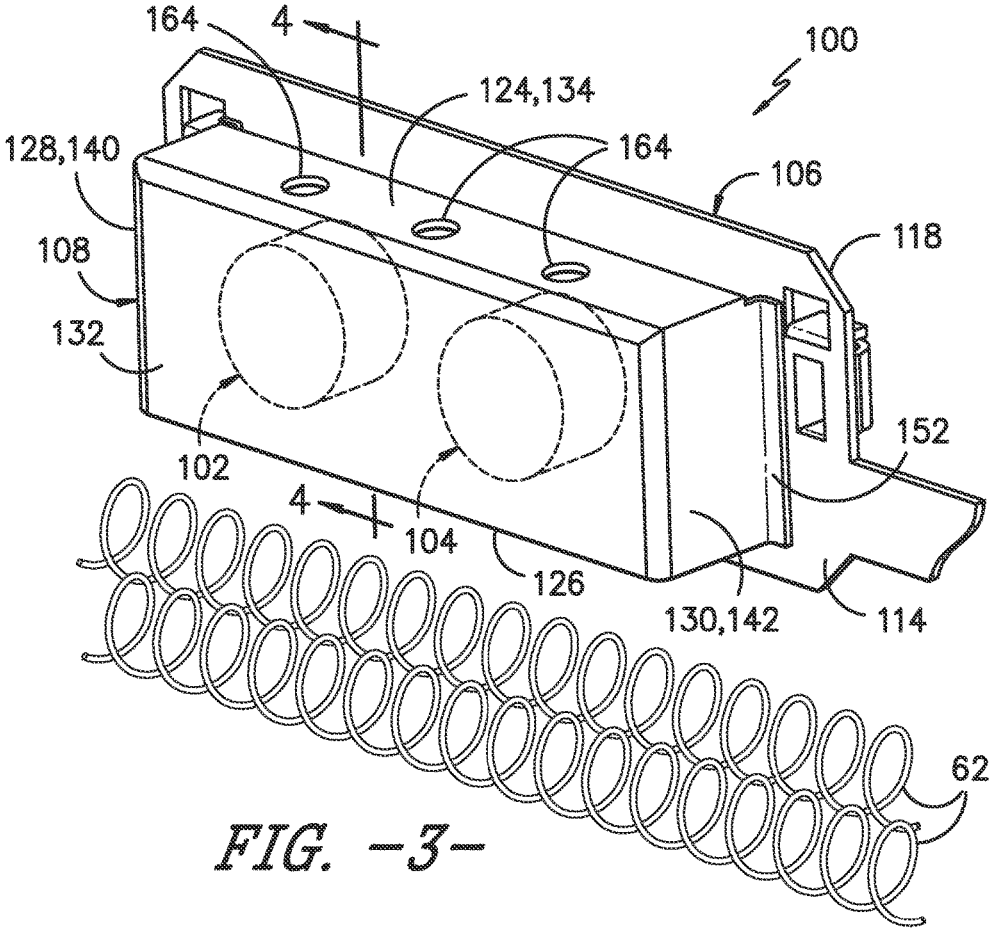
FIG. 3 illustrates a perspective view of one embodiment of a thermostat hood suitable for use within the heating system shown in FIG. 2, particularly illustrating the thermostat hood coupled to a support mount of the heating system so as to at least partially encase or surround first and second thermostats of the heating system.
Figure 4:
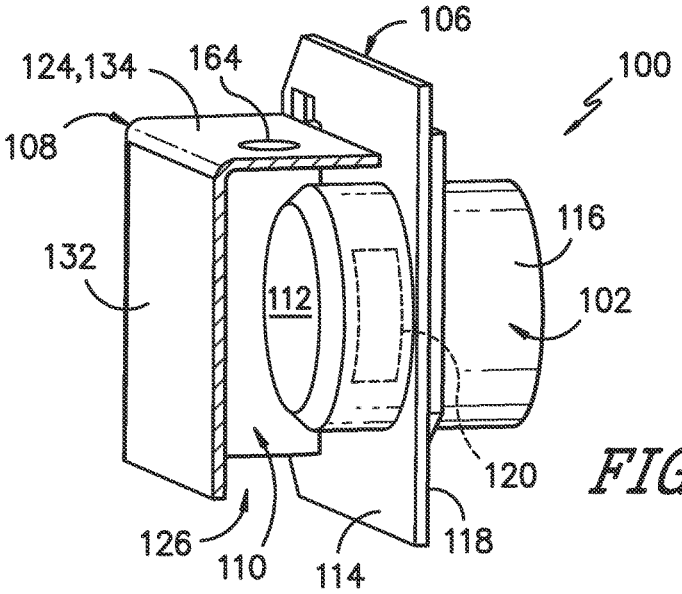
FIG. 4 illustrates a cross-sectional view of the thermostat hood shown in FIG. 3 taken about line 4-4.
Figure 5:
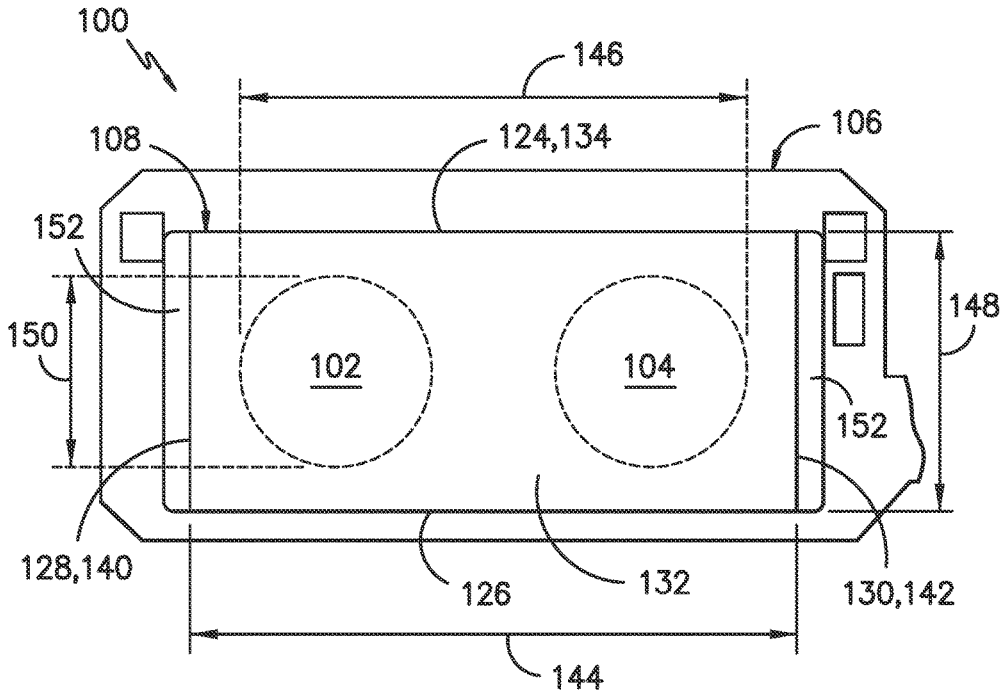
FIG. 5 illustrates a front view of the thermostat hood shown in FIG. 3
Figure 6:
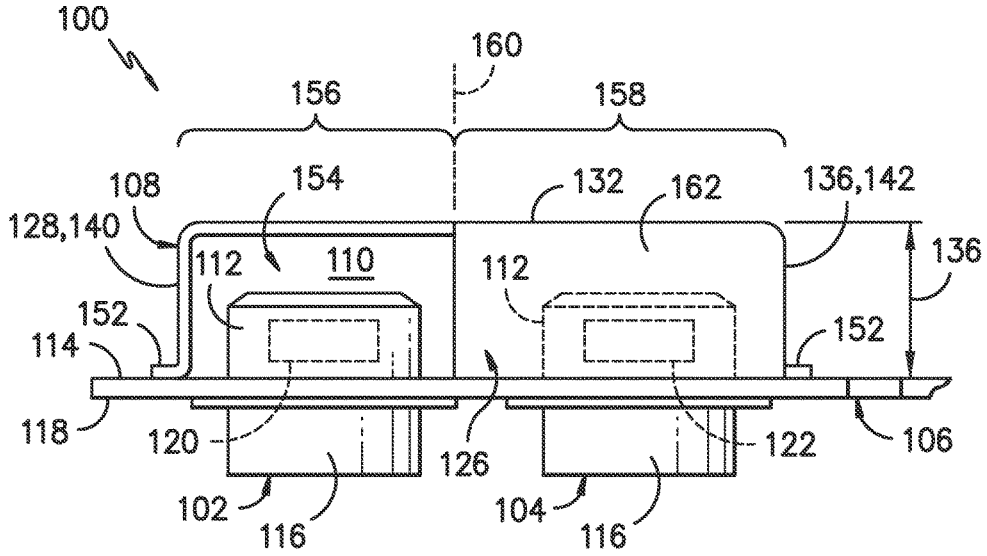
FIG. 6 illustrates a bottom view of the thermostat hood shown in FIG. 3.

Referring now to FIGS. 3-6, various components of the heating system 100 described above are illustrated in accordance with aspects of the present subject matter. Specifically, FIG. 3 illustrates a perspective view of one embodiment of a thermostat hood 108 that may be positioned around the thermostats 102, 104 of the heating system 100 to assist in drawing the heated air rising from the heating coils 62 across one or both of the thermostats 102, 104. FIG. 4 illustrates a cross-sectional view of the thermostat hood 108 shown in FIG. 3 taken about line 4-4, particularly illustrating one of the thermostats 102 disposed within the interior of a hood chamber 110 defined between the thermostat hood 108 and the support mount 106. Additionally, FIGS. 5 and 6 illustrate front and bottom views, respectively, of the thermostat hood 108 shown in FIG. 3.

As indicated above, the thermostats 102, 104 of the heating system 100 may be configured to be supported at a location directly above the heating coils 62 via a support mount 106. In general, the support mount 106 may correspond to any suitable wall, bracket and/or other mounting component contained within the air conditioner unit 10 at a suitable location for mounting the thermostats 102, 104 above the heating coils 62. For example, in the embodiment shown above in FIG. 2, the support mount 106 generally corresponds to a mounting bracket or arm extending laterally from the first sidewall 38 at a location vertically above the heating coils 62. However, in other embodiments, the support mount 106 may correspond to any other suitable mounting feature and/or component.

As particularly shown in FIGS. 4 and 6, in one embodiment, each thermostat 102, 104 may be configured to be mounted through an opening (not shown) defined in the support mount 106 such that a first portion 112 of each thermostat 102, 104 extends outwardly from a forward surface 114 of the support mount 106 and a second portion 116 extends outwardly from a rear surface 118 of the support mount 106. Additionally, in several embodiments, a temperature sensitive element 120, 122, such as a bimetallic element or a thermal fuse, may be housed within the first portion 112 of each thermostat 102, 104 for monitoring the ambient air temperature within the disclosed thermostat hood 108.

As shown in the illustrated embodiment, the thermostat hood 108 may generally correspond to a box-like cover configured to be coupled to the support mount 106 so as to at least partially surround or encase the thermostats 102, 104. In several embodiments, the hood 108 may be configured to extend vertically between a top side 124 and a bottom side 126 and laterally between a first side 128 and a second side 130. As particularly shown in FIGS. 3 and 4, the hood 108 may generally include a front wall 132 configured to be spaced apart from the support mount 106 (e.g., by a distance 146 (FIG. 6)) and a top wall 134 extending outwardly from the front wall 132 in the direction of the support mount 106 so as to define the top side 124 of the thermostat hood 108. In addition, the thermostat hood 108 may include a first sidewall 140 extending between the front wall 132 and the support mount 104 along the first side 128 of the hood 108 at a location adjacent to the first thermostat 102 and a second sidewall 142 extending between the front wall 132 and the support mount 104 along the second side 130 of the hood 108 at a location adjacent to the second thermostat 104. As such, the front wall 132, the top wall 134 and the sidewalls 140, 142 of the thermostat hood 108, along with the support mount 106, may generally define a hood chamber 110 (FIGS. 4 and 6) within which each thermostat 102, 104 may be at least partially housed. For example, as shown in FIGS. 4 and 6, the first portion 112 of each thermostat 102, 104 may be configured to extend outwardly from the forward surface 114 of the support mount 106 so as to be contained within the hood chamber 110.

It should be appreciated that the thermostat hood 108 may generally be configured to define any suitable lateral and/or vertical dimensions that allow the hood 108 to at least partially cover or surround both thermostats 102, 104. For example, as shown in FIG. 5, the thermostat hood 108 defines a lateral width 144 between its first and second sidewalls 140, 142 that is greater than a lateral distance 146 defined between the outer lateral edges of the thermostats 102, 104. Similarly, the thermostat hood 108 defines a vertical height 148 between its top and bottom sides 124, 126 that is greater than a vertical height 150 defined by each thermostat 102, 104.

It should also be appreciated that the thermostat hood 108 may be configured to be coupled to the support mount 106 using any suitable attachment means and/or method known in the art. For example, as shown in the illustrated embodiment, the thermostat hood 108 includes a mounting flange 152 extending outwardly from each sidewall 140, 142 at a location adjacent to the support mount 106. In such an embodiment, the mounting flanges 152 may be configured to be secured to the support mount 106 in order to couple the hood 108 to the support mount 106. For instance, the mounting flanges 152 may be welded to the support mount 106 or coupled to the support mount 106 using mechanical fasteners (e.g., bolts, screws, pins, rivets, etc.) and/or any other suitable fastening means.

Additionally, in accordance with aspects of the present subject matter, at least a portion of the bottom side 126 of the thermostat hood 108 may be open to allow heated air rising form the heating coils 62 to be drawn into the hood chamber 110 and directed across one or more of the thermostats 102, 104. For example, in several embodiments, an air intake opening 154 may be defined along the bottom side 126 of the thermostat hood 106 for capturing the heated air rising from the heating coils 62. As shown in FIG. 6, the air intake opening 154 may, in one embodiment, only be configured to span across a portion of the bottom side 126 of the hood 108. Specifically, in the illustrated embodiment, the air intake opening 154 is only defined across a first lateral portion 156 of the bottom side 126 that extends laterally from the first sidewall 140 to a central location (indicated by reference line 160 in FIG. 6) defined between the first and second thermostats 102, 104 such that the air intake opening 154 is disposed directly below the first thermostat 102. In such an embodiment, thermostat hood 108 may include a bottom wall 162 covering a second lateral portion 158 of its bottom side 126 that extends laterally from the central location 160 to the second sidewall 142 such that the bottom wall 162 is disposed directly below the second thermostat 104.

It should be appreciated that the configuration of the bottom side 126 of the thermostat hood 108 shown in FIG. 6 may often be desirable when one of the thermostats 102, 104 is configured as a one-shot thermostat as opposed to a resettable thermostat. For example, in the illustrated embodiment, the first thermostat 102 may correspond to a resettable thermostat whereas the second thermostat 104 may correspond to one-shot thermostat. In such an embodiment, the heated air may be drawn primarily across the first thermostat 102 as it enters the hood chamber 110 via the air intake opening 154 while second thermostat 104 is shielded from the direct flow of heated air rising from the heating coils 62 via the bottom wall 162. As such, the first thermostat 102 may be heated more quickly than the second thermostat 104, thereby allowing the first thermostat 102 to serve as the primary means for regulating the internal temperature within the air conditioner unit 10. Specifically, given the direct flow of hot air across the first thermostat 102, the first thermostat 102 may reach its predetermined cut-off temperature prior to the second thermostat 104. In such instance, the second thermostat 104 would only reach its predetermined cut-off temperature in the event of malfunction or failure of the first thermostat 102.

Additionally, it should be appreciated by those of ordinary skill in the art that a resettable thermostat generally corresponds to a thermostat that is capable of continuously cutting off and reconnecting the power to the heating coils 62 as the temperature fluctuates above and below the predetermined cut-off temperature for the thermostat. For example, resettable thermostats often include a temperature sensitive element 120, such as a bimetallic element, that switches from a first position to a second position as the temperature increases above the cut-off temperature and then switches back to the original, first position when the temperature subsequently drops below the cut-off temperature. In such an embodiment, the temperature sensitive element 120 may form part of or may be coupled to a switching element that controls the supply of power to the heating coils 62 based on the position of the temperature sensitive element 120. In contrast, a one-shot thermostat generally corresponds to a thermostat that is not configured to reconnect the power to the heating coils 62 once the temperature has increased above the predetermined cut-off temperature for the thermostat. For example, unlike resettable thermostats, one-shot thermostats often include a temperature sensitive element 122, such as a one-shot thermal fuse, that is configured to switch (or snap) from a first position to a second position when the temperature increases above its cut-off temperature and then remains in the second position even when the temperature subsequently drops below the cut-off temperature.

Figure 7:
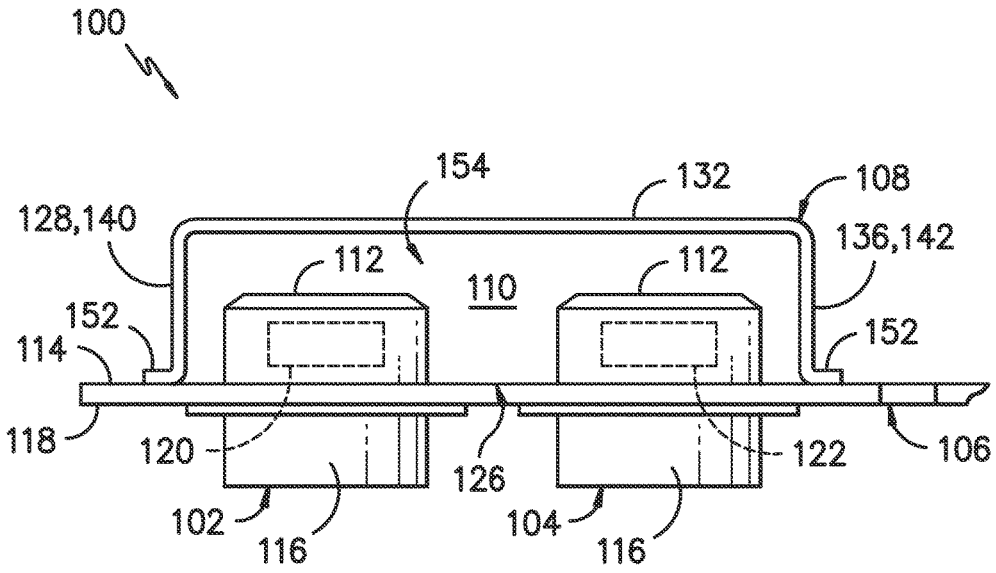
FIG. 7 illustrates another bottom view the thermostat hood shown in FIG. 3, particularly illustrating an alternative configuration for the bottom side of the thermostat hood.

It should also be appreciated that, in alternative embodiments, the thermostat hood 108 may define a completely open bottom side 126. For example, FIG. 7 illustrates an alternative configuration for the bottom side 126 of the thermostat hood 108 shown in FIG. 6. As shown in FIG. 7, the air intake opening 154 is defined across the entire bottom side 126 of the thermostat hood 108. As such, heated air rising from the heating coils 62 may be drawn across both thermostats 102, 104.

Referring back to FIGS. 3-6, in several embodiments, one or more exhaust openings 164 may be defined in the top wall 134 of the thermostat hood 108 to provide a means for the heated air entering the hood chamber 110 via the air intake opening 154 to be expelled therefrom. As such, a continuous flow of air may be drawn across the thermostat(s) 102, 104 during operation of the heating system 100. It should be appreciated that any number of exhaust openings 164 may be defined in the top wall 134. For example, as shown in FIG. 3, three exhaust openings 164 are defined in the top wall 134. However, in other embodiments, less than three exhaust openings 164, such as one or two exhaust openings, or more than three exhaust openings 164, such as four or more exhaust openings, may be defined in the top wall 134. It should also be appreciated that, in other embodiments, one or more exhaust openings 164 may also be defined in any other suitable wall of the thermostat hood 108, such as the front wall 132 or one or both of the sidewalls 140, 142.

It should be appreciated that, although the present subject matter has generally be described herein with reference to a heating system 100 that includes two thermostats 102, 104, the heating system 100 may, instead, include a single thermostat or three or more thermostats. In such embodiments, the configuration of the disclosed thermostat hood 108 may be modified, as necessary, to accommodate the specific number of thermostats included within the heating system 100.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. A heating system for an air conditioner unit, the heating system comprising:

a heating coil positioned within the air conditioner unit, the heating coil being configured to heat an airflow passing through the air conditioner unit;

a thermostat positioned within the air conditioner unit above the heating coil, the thermostat being configured to regulate a temperature within the air conditioner unit and being supported above the heating coil by a support mount;

a thermostat hood configured to at least partially surround the thermostat, the thermostat hood extending vertically between a top side and a bottom side and laterally between a first side and a second side, the thermostat hood including a front wall spaced apart from the support mount and a top wall extending between the front wall and the support mount so as to define the top side of the thermostat hood, the thermostat hood further including first and second sidewalk extending between the front wall and the support mount so as to define the first and second sides of the thermostat hood, respectively, the front wall, the top wall, the first and second sidewalls and the support mount collectively defining a hood chamber for receiving at least a portion of the thermostat, wherein at least a portion of the bottom side of the thermostat hood defines an air intake opening for receiving a portion of the convective heated airflow rising upward from the heating coil, wherein the thermostat and the thermostat hood are positioned directly vertically above the heating coil such that the air intake opening is vertically aligned with the portion of the convective heated airflow rising upward from the heating coil.

2. The heating system of claim 1, wherein the air intake opening is defined directly below the thermostat along the bottom side of the thermostat hood.

3. The heating system of claim 1, wherein the top wall defines at least one exhaust opening for expelling the convective heated airflow flowing into the hood chamber via the air intake opening.

4. The heating system of claim 1, wherein the thermostat corresponds to a first thermostat and further comprising a second thermostat supported directly vertically above the heating coil by the support mount, both of the first and second thermostats being at least partially received within the hood chamber.

5. The heating system of claim 4, wherein the first and second thermostats are spaced apart from one another laterally along the support mount such that the first thermostat is located adjacent to the first sidewall and the second thermostat is located adjacent to the second sidewall.

6. The heating system of claim 4, wherein the bottom side of the thermostat hood includes a first lateral portion disposed below the first thermostat and a second lateral portion disposed below the second thermostat, the air intake opening being defined along the first lateral portion of the bottom side, the thermostat hood further including a bottom wall extending along the second lateral portion of the bottom side.

7. The heating system of claim 6, wherein the bottom wall is configured to shield the second thermostat from the convective heated airflow rising upward from the heating coil.

8. The heating system of claim 6, wherein the first thermostat corresponds to a resettable thermostat and the second thermostat corresponds to a one-shot thermostat.

9. The heating system of claim 1, wherein each of the first and second sidewalls includes a mounting flange extending outwardly therefrom, the mounting flange being configured to be coupled to the support mount.

10. The heating system of claim 1, wherein the thermostat includes a first portion extending outwardly from a forward surface of the support mount and a second portion extending outwardly from a rear surface of the support mount, the first portion being positioned inside the hood chamber and the second portion being positioned outside the hood chamber.

11. The heating system of claim 1, wherein the air intake opening extends laterally along substantially the entire bottom side of the thermostat hood.

12. The heating system of claim 1, wherein the thermostat includes a temperature sensitive element.

13. The heating system of claim 12, wherein the temperature sensitive element comprises a bimetallic element or a thermal fuse.

14. A heating system for an air conditioner unit, the heating system comprising:

a heating coil positioned within the air conditioner unit, the heating coil being configured to heat an airflow passing through the air conditioner unit;

first and second thermostats positioned within the air conditioner unit above the heating coil, the first and second thermostats being supported above the heating coil by a support mount;

a thermostat hood configured to at least partially surround the first and second thermostats, the thermostat hood extending vertically between a top side and a bottom side and laterally between a first side and a second side, the thermostat hood including a front wall spaced apart from the support mount and a top wall extending between the front wall and the support mount so as to define the top side of the thermostat hood, the thermostat hood further including first and second sidewalls extending between the front wall and the support mount so as to define the first and second sides of the thermostat hood, respectively, the front wall, the top wall, the first and second sidewalls and the support mount collectively defining a hood chamber for receiving at least a portion of each of the first and second thermostats, wherein at least a portion of the bottom side of the thermostat hood defines an air intake opening below at least one of the first thermostat or the second thermostat for receiving a portion of the convective heated airflow rising upward from the heating coil and the top wall defines at least one exhaust opening for expelling the convective heated airflow flowing into the hood chamber via the air intake opening, wherein the first and second thermostats and the thermostat hood are positioned directly vertically above the heating coil such that the air intake opening is vertically aligned with the portion of the convective heated airflow rising upward from the heating coil.

15. The heating system of claim 14, wherein the bottom side of the thermostat hood includes a first lateral portion disposed below the first thermostat and a second lateral portion disposed below the second thermostat, the air intake opening being defined along the first lateral portion of the bottom side, the thermostat hood further including a bottom wall extending along the second lateral portion of the bottom side.

16. The heating system of claim 15, wherein the bottom wall is configured to shield the second thermostat from the convective heated airflow rising upward from the heating coil.

17. The heating system of claim 15, wherein the first thermostat corresponds to a resettable thermostat and the second thermostat corresponds to a one-shot thermostat.

18. The heating system of claim 14, wherein the air intake opening extends laterally along substantially the entire bottom side of the thermostat hood.

19. The heating system of claim 14, wherein each of the first and second thermostats includes a temperature sensitive element, the temperature sensitive element comprising one of a bimetallic element or a thermal fuse.

20. The heating system of claim 14, wherein each of the first and second sidewalls includes a mounting flange extending outwardly therefrom, the mounting flange being configured to be coupled to the support mount.

* * * * *